US007852215B2

(12) United States Patent
Marin Palacios et al.

(10) Patent No.: US 7,852,215 B2
(45) Date of Patent: Dec. 14, 2010

(54) MAGNETIC TAG THAT CAN BE ACTIVATED/DEACTIVATED BASED ON MAGNETIC MICROWIRE AND A METHOD FOR OBTAINING THE SAME

(75) Inventors: Pilar Marin Palacios, Pozuelo de Alarcón (ES); Daniel Cortina Blanco, Boadilla del Monte (ES); Javier Calvo Robledo, Pozuelo de Alarcón (ES)

(73) Assignee: Micromag 2000, S.L., Madrid (ES)

( * ) Notice: Subject to any disclaimer, the term of this patent is extended or adjusted under 35 U.S.C. 154(b) by 226 days.

(21) Appl. No.: 11/406,692

(22) Filed: Apr. 19, 2006

(65) Prior Publication Data

US 2007/0096913 A1 May 3, 2007

(30) Foreign Application Priority Data

Apr. 21, 2005 (ES) ..... 200500970

(51) Int. Cl.
*G08B 13/14* (2006.01)

(52) U.S. Cl. ..... 340/572.1; 235/385; 340/572.3

(58) Field of Classification Search ... 340/572.1–572.6, 340/551; 235/381–385; 148/120, 121; 428/611
See application file for complete search history.

(56) References Cited

U.S. PATENT DOCUMENTS 4,660,025 A * 4/1987 Humphrey ..... 340/572.2
4,686,516 A * 8/1987 Humphrey ..... 340/572.3
4,746,908 A 5/1988 Montean
4,956,636 A * 9/1990 Sansom et al. ..... 340/551
4,980,670 A 12/1990 Humphrey et al.
5,191,315 A 3/1993 Cordery et al.
5,246,522 A 9/1993 Cordery et al.
5,313,192 A * 5/1994 Ho et al. ..... 340/551
5,401,584 A * 3/1995 Minasy et al. ..... 428/611

(Continued)

FOREIGN PATENT DOCUMENTS

EP 0 260 831 8/1987

(Continued)

OTHER PUBLICATIONS

Chiriac et al., "Amorphous glass-covered magnetic wires: Preparation, properties, applications," *Progress in Materials Science* (1996) 40: 333-407.

(Continued)

*Primary Examiner*—Brent Swarthout
(74) *Attorney, Agent, or Firm*—Merchant & Gould P.C.

(57) ABSTRACT

The invention refers to a magnetic tag that can be activated/deactivated, formed by at least two components based on magnetic microwire, characterized in that:

the first component comprises a first array of soft magnetic microwire segments (1) with a bistable magnetic behaviour, said segments arranged in a substantially aligned manner in a direction parallel to the axial direction of the microwire, and the second component comprises a second array of hard magnetic microwire segments (2), said hard magnetic microwire segments preferably being of substantially the same length, and are arranged equidistantly from each other and substantially aligned in a direction parallel to that of the first component.

The invention also refers to a method for obtaining a tag that can be activated/deactivated based on magnetic microwire.

18 Claims, 5 Drawing Sheets

U.S. PATENT DOCUMENTS

| | | | | |
|---|---|---|---|---|
| 5,801,630 | A | 9/1998 | Ho et al. | |
| 6,166,636 | A * | 12/2000 | Herget et al. | 340/572.6 |
| 6,259,368 | B1 * | 7/2001 | Ruhrig | 340/572.6 |
| 6,475,303 | B1 | 11/2002 | Hasegawa et al. | |
| 6,685,091 | B2 * | 2/2004 | Rapp et al. | 235/385 |
| 6,747,559 | B2 * | 6/2004 | Antonenco et al. | 340/572.1 |
| 6,774,793 | B1 * | 8/2004 | Brauer et al. | 340/572.3 |
| 7,044,369 | B2 * | 5/2006 | Gantz | 235/381 |
| 2003/0085809 | A1 | 5/2003 | Antonenco et al. | |

FOREIGN PATENT DOCUMENTS

| | | | |
|---|---|---|---|
| EP | 0 577 015 | A1 | 6/1993 |
| FR | 763681 | | 11/1933 |
| WO | WO 98/20467 | | 5/1998 |
| WO | WO 01/53575 | A1 | 7/2001 |
| WO | WO 01/63577 | A1 | 8/2001 |
| WO | WO 2005/027018 | A2 | 3/2005 |

OTHER PUBLICATIONS

Vasquez et al., "Magnetic properties of glass-coated amorphous and nanocrystalline microwires," *Journal of Magnetism and Magnetic Materials* (1996) 160: 223-228.

Vásquez et al., "The magnetization reversal process in amorphous wires," *IEEE Transactions of Magnetics* (1995) 31 (2): 1229-1238.

Donald et al., "The preparation, properties and applications of some glass-coated metal filaments prepared by the Taylor-wire process," *Journal of Materials Science* (1996) 31: 1139-1149.

Wesner et al., "Magnetic properties of amorphous Fe-P alloys containing Ga, Ge and As, " *Phys. Stat. Sol*. (1974) 26: 71-75.

* cited by examiner

MAGNETIC TAG THAT CAN BE ACTIVATED/DEACTIVATED BASED ON MAGNETIC MICROWIRE AND A METHOD FOR OBTAINING THE SAME

FIELD OF THE INVENTION

The present invention refers to a magnetic tag that can be activated/deactivated for electronic surveillance of items based on magnetic microwires.

The invention is comprised within the technical field of magnetic materials and also covers electromagnetism aspects, with applications in the fields of sensors and detectors and metallurgy.

BACKGROUND OF THE INVENTION

There are different systems for the electronic detection of items based on magnetic phenomena, which particularly comprehend tags that can be activated/deactivated and their manufacturing method, the detector thereof and the system of activating/deactivating said tags.

The magnetic tag, object of the present invention, can be used in this type of systems and is based on magnetic microwires obtained by the Taylor process.

The Taylor process is known for the manufacturing of microwires that allows obtaining microwires with very small diameters, comprised between one and various tenths of a micrometer, by a simple process. The microwires thus obtained can be made from a great variety of magnetic and non-magnetic alloys and metals. This process is described, for example, in the article "*The Preparation, Properties and Applications of some Glass Coated Metal Filaments Prepared by the Taylor-Wire Process*" W. Donald et al., Journal of Material Science, 31, 1996, pp 1139-1148.

The most important characteristic of the Taylor method or process is that it allows obtaining metals and alloys in the form of a microwire with insulating sheath in a single simple operation, which entails a cost-reduction in the manufacturing process.

The process for obtaining magnetic microwires with insulating sheath and amorphous microstructure is described, for example, in the article "*Magnetic Properties of Amorphous Fe_P Alloys Containing Ga, Ge and As*" H. Wesner and J. Schneider, Stat. Sol. (a) 26, 71 (1974), Phys. Stat. Sol. (a) 26, 71 (1974).

The properties of magnetic amorphous microwire with insulating sheath, related to the object of the present invention, are described in the article "*Amorphous glass-covered magnetic wires: preparation, properties, applications*", H. Chiriac, T A Óvári 1997 In: *Progress in Materials Science*, Elsevier Science Ltd. Great Britain, Vol 40, pp. 333-407.

The alloys used in the manufacturing of the microwire core are of the transition metal metalloid type and have an amorphous microstructure. The influence of the geometry of the microwire on its magnetic behaviour is due to the magnetoelastic character of the alloys used that, in turn, depend on the magnetostriction constant thereof.

Systems for detecting items based on magnetic materials are well known. The Picard patent (French patent FR-763, 681) shows the first device of this type. The described device is based on the use of a Permalloy-type soft magnetic material tape that, when subjected to an alternating magnetic field, induces harmonics in a detector which are clearly different from those originated by other types of metals.

Ever since Picard filed his patent, there have been great efforts to improve tags from the point of view of their size, as well as their detectability at a distance from the receiver and the possibility of activating and deactivating them. The greater part of the effort has been centered on finding materials with lower coercive forces and greater permeability than permalloy. As the voltage pulse generated in the detector due to the presence of the tag depends on the characteristics of the hysteresis cycle of the metal used, the attempt has always been made to find materials with low coercive force and high permeability in order to obtain higher order harmonics, and with a higher amplitude, for lower values of the applied field, thus making the tag easier to distinguish.

Amorphous magnetic materials in the form of tape have low coercive forces and high susceptibilities that can be optimized to be used in electronic equipment for detecting items by means of suitable heat treatments in the presence or absence of a magnetic field. Thus, for example, U.S. Pat. No. 6,475,303 refers to the use of compositions based on CoNiFeSiBC.

There are other materials that have clear advantages from the detection point of view. These are amorphous materials having magnetic bistability in their hysteresis cycles. This phenomenon is related to the occurrence of a Barkhausen jump in the hysteresis cycle of the material for a certain value of the applied magnetic field. The material has a remanence magnetization value that is not zero for a zero field. To reverse this magnetization, it is necessary to apply a magnetic field in the opposite direction. The critical field is the minimum field necessary to achieve the magnetization reversal. This behaviour is fundamentally found in wires. (*The magnetization reversal in amorphous wires*. M. Vázquez, D. X. Chen 1995 IEEE Trans. Magn. 31, 1229-1238) and in amorphous magnetic microwires with a high longitudinal anisotropy due to their high magnetostriction constant (*Magnetic Properties of glass-coated amorphous and nanocrystalline wires*, M. Vázquez, A. P. Zhukov 1996, *J. Magn. Magn Mat*. 160, 223-228).

When a bistable magnetic material is used in a detection system, the pulse detected due to its presence is substantially independent of the variation rhythm of the magnetizing field and of the intensity thereof, as long as this intensity exceeds a minimum threshold value.

U.S. Pat. No. 4,660,025 discloses a detection system in which a bistable amorphous magnetic wire with a minimum length of 7.6 cm is used as a tag. In this case, an alternating magnetic field is applied to a certain area of space and an alarm is activated when a disturbance is detected in said magnetic field. This happens when a tag is introduced in this area and the magnetic field value exceeds the critical field of the wire, producing a magnetization reversal. This is known as "snap action".

The advantages of detectors based on bistable magnetic behaviour in which the tag is based on magnetic wires can clearly be deduced from the results obtained with the latter type of materials, but the great length of the tag is a great drawback.

In addition to the advantages obtained with the tag in U.S. Pat. No. 4,660,025 which refer to its high harmonic content and its high pulse, it is important to find the possibility of deactivating this type of magnetic materials. U.S. Pat. No. 4,686,516 shows a way of doing this by the crystallization of the amorphous magnetic material. This is done by heating at least one part of the tag to a temperature that exceeds its crystallization temperature, by applying an electric current or a radiant energy such as a laser. Although some of the methods herein set forth allow deactivating the tag without touching it, they need to be cautiously applied.

U.S. Pat. No. 4,980,670 discloses a magnetic marker for the electronic surveillance of items in which the tag has "snap action" for low threshold values of the applied magnetic field, and, moreover, the tag is easily deactivated. This patent includes a method for manufacturing the tag based on magnetic films, the development of a detector and of a deactivator.

The conditions described in this patent for obtaining amorphous tapes with a bistable magnetic behaviour in the hysteresis cycle are based on special heat treatments of amorphous magnetic tapes to achieve the joining of magnetic domain walls. A certain number of compositions based on CoFeSiB, as well as treatment temperatures and times, are described in this patent.

The deactivation of this tag is carried out by subjecting the tag to a high-frequency and high amplitude alternating magnetic field. In this way, a great number of magnetic domains are created in the tape. The appearance of these domains in the tape avoids a Barkhausen jump in the hysteresis cycle, which makes the tag useless.

U.S. Pat. No. 5,313,192 discloses a tag that is equivalent to the one in U.S. Pat. No. 4,980,670, but more stable and controllable. The conditions for processing the amorphous magnetic tape are the same but the tag is also subjected to predetermined magnetic fields during the processing, which allow its activation and deactivation. More particularly, the tag of this invention contains a soft magnetic material forming the principal core, and a second hard or semi-hard magnetic material. This tag is conditioned in such a way that the second material has activated and deactivated states, respectively. In the activated state, the tag exhibits bistable hysteresis, whereas in deactivated state the tag has a hysteresis cycle without Barkhausen jumps.

U.S. Pat. No. 6,747,559 refers to a permanent tag for the electronic detection of items based on magnetic wires with low coercive forces (less than 10 A/m) and high magnetic permeability (greater than 20000). The length of the microwire or microwires used is not greater than 32 mm. In this case, it is the high permeability which allows obtaining high order harmonics, and with a high amplitude, for sufficiently low applied field values, thus making the tag easy to distinguish.

DESCRIPTION OF THE INVENTION

The invention refers to a magnetic tag that can be activated/deactivated, based on magnetic microwire according to claim 1, and a method for obtaining said tag according to claim 16. Preferred embodiments of the tag and of the method are defined in the dependent claims.

According to a first aspect of the present invention, this refers to a magnetic tag that can be activated/deactivated, formed by at least two components based on magnetic microwire, in which:

the first component comprises a first array of soft magnetic microwire segments with a bistable magnetic behaviour, said segments arranged in a substantially aligned manner in a direction parallel to the axial direction of the microwire, and the second component comprises a second array of hard magnetic microwire segments, said hard magnetic microwire segments being arranged equidistantly from each other and substantially aligned in a direction parallel to that of the first component.

Said hard magnetic microwire segments preferably substantially have the same length.

The total minimum length of the tag is preferably 35 nm

Said hard magnetic microwire segments preferably have a length between 3 mm and 6 mm.

Said hard magnetic microwire segments are preferably arranged with a minimum distance of between 4 mm and 5 mm between them.

Said magnetic microwire segments of the first and second components preferably have a minimum diameter of 20 μm.

Said soft magnetic microwire preferably has a high longitudinal anisotropy associated to its geometry and to its nil or positive magnetostriction constant.

Said hard magnetic microwire segments can be obtained by heat treatment exceeding the crystallization temperature of the amorphous microwires. That is, said hard microwire segments can be obtained by heat treatments of amorphous magnetic microwires in general, they may or may not be the same as those of the soft part of the tag (if it is of interest, they can be).

Said tag can have an activated state, obtained as a result of subjecting the same to an alternating magnetic field, and the hard magnetic microwire segments being demagnetized.

It can also have a deactivated state, obtained as a result of subjecting the same to constant magnetic field, and the hard magnetic microwire segments being magnetized in their remanence state.

The tag in its activated state is preferably configured to respond to a magnetic field value that is greater than the critical field of the bistable hysteresis cycle associated to its magnetically soft part in detection by induction systems.

Said soft magnetic microwire is preferably configured to give rise to high order harmonics, and with a high amplitude, for applied field values lower than 100 A/m.

The magnetic tag can be formed from soft magnetic microwire segments alternated with hard magnetic microwire segments.

Or said soft magnetic microwire segments can be arranged one after the other, forming a single soft magnetic wire.

The tag can also be formed from a single magnetic microwire subjected to localized heat treatments corresponding to said hard magnetic microwire segments.

The magnetic tag that can be activated/deactivated of this invention can be used for the electronic detection of objects.

In this way, the tag here described can be adjusted and can function in any of the already existing equipment, as well as be activated and deactivated in the corresponding equipment.

According to a second aspect of the present invention, this refers to a method for obtaining a magnetic tag that can be activated/deactivated and comprising:

obtaining a first array of soft magnetic microwire segments with a bistable magnetic behaviour, arranging said soft magnetic microwire segments in a substantially aligned manner in a direction that is parallel to the axial direction of the microwire, obtaining a second array of hard magnetic microwire segments, arranging said hard magnetic microwire segments equidistantly from each other, and substantially aligned in a direction that is parallel to said soft magnetic microwire segments.

Said hard magnetic microwire segments preferably have substantially the same length.

The method preferably comprises obtaining a tag with a minimum total length of 35 mm.

It preferably comprises obtaining segments of hard magnetic microwire segments having a length between 3 mm and 6 mm.

Said hard magnetic microwire segments are preferably at a distance of between 4 mm and 5 mm between each other The method preferably comprises obtaining said hard magnetic microwire segments by heat treatment exceeding the crystallization temperature of amorphous microwires.

The method can comprise alternating soft magnetic microwire segments with hard magnetic microwire segments.

Or it may comprise obtaining a single soft magnetic microwire.

Said single soft magnetic microwire can also be subjected to localized heat treatments to form said hard magnetic microwire segments (that would thus be in an alternating arrangement).

The method preferably comprises activating said magnetic tag by subjecting the same to an alternating magnetic field, and the hard magnetic microwire segments being demagnetized.

The method can also comprise deactivating said magnetic tag by subjecting the same to a constant magnetic field, and the hard magnetic microwire segments being demagnetized in their remanence state.

BRIEF DESCRIPTION OF THE DRAWING

A series of drawings are described below which will help to understand the invention better and which are expressly related to an embodiment of said invention shown as a non-limiting example thereof.

DESCRIPTION OF THE EMBODIMENT OF THE INVENTION

The magnetic tag of the invention has a minimum length of 35 mm and contains a core that is a soft magnetic microwire (with a high magnetic susceptibility and low coercive force or bistable), and a second magnetically hard microwire.

Figure 1A:
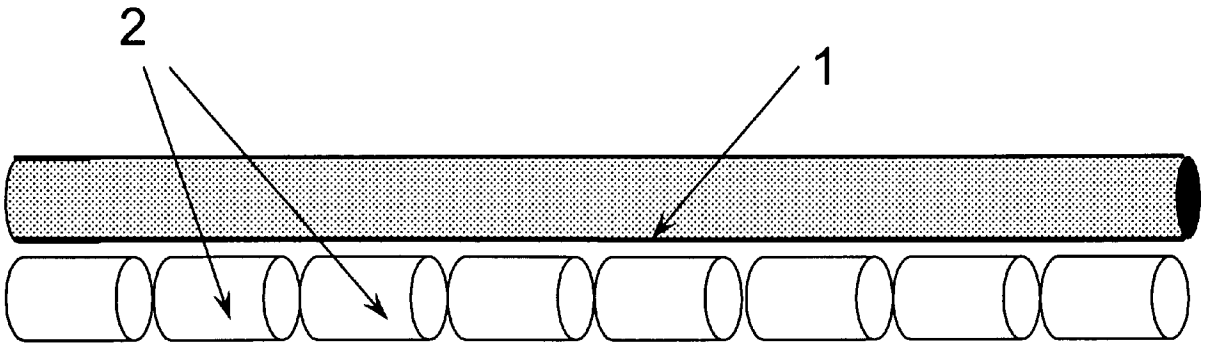
FIGS. 1*a* and 1*b* show two possible arrangements of the soft and hard magnetic microwires for the tag of the invention.

With these features, there is a possible arrangement for the tag that is shown in FIG. 1*a*, with a 35 mm magnetically soft microwire 1 aligned with various equidistant non-bistable hard magnetic microwire fractions 2 with sizes between 3-6 mm.

Figure 1B:
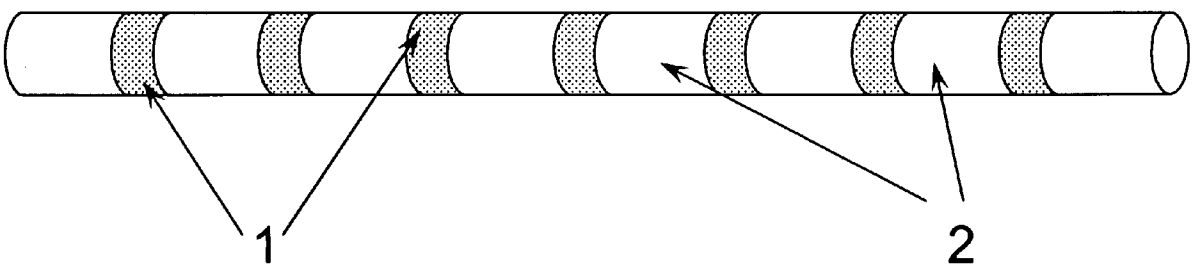

The tag arrangement that is shown in FIG. 1*b* can also be carried out, with a single 35 mm microwire with two alternating magnetic microstructures, hard 2 and soft 1 throughout its length.

The described magnetic tags are obtained in the following way:

the magnetically soft microwire or microwire segments (according to the arrangement in FIG. 1*a* or 1*b*) are prepared by the Taylor process adapting its composition and geometry to the required magnetic property.

This same microwire is subjected to heat treatments exceeding the crystallization temperature of the material, giving rise to a hard magnetic microwire and giving rise to the tag arrangement shown in FIG. 1*b*.

In the two cases shown in FIGS. 1*a* and 1*b*, when the tag is activated, the hard magnetic material parts are in magnetization state zero and the hysteresis cycle of the assembly behaves like a soft one due to its high magnetic susceptibility or to its magnetic bistability. In the deactivated tag, the hard magnetic material is in remanence, preventing a Barkhausen jump in the hysteresis cycle.

The activation and deactivation are carried out using an equipment formed by an electromagnet that can be connected to an alternating current source and to a direct current source such that an alternating and a constant magnetic field are created, respectively.

In order to activate it, the tag is subjected to an alternating magnetic field so that the hard magnetic component acquires such a domain structure that it has zero magnetization. Tag deactivation is carried out by subjecting it to a constant magnetic field high enough to magnetize the hard magnetic material, so that it stays in remanence when the field is disconnected.

Figure 2:
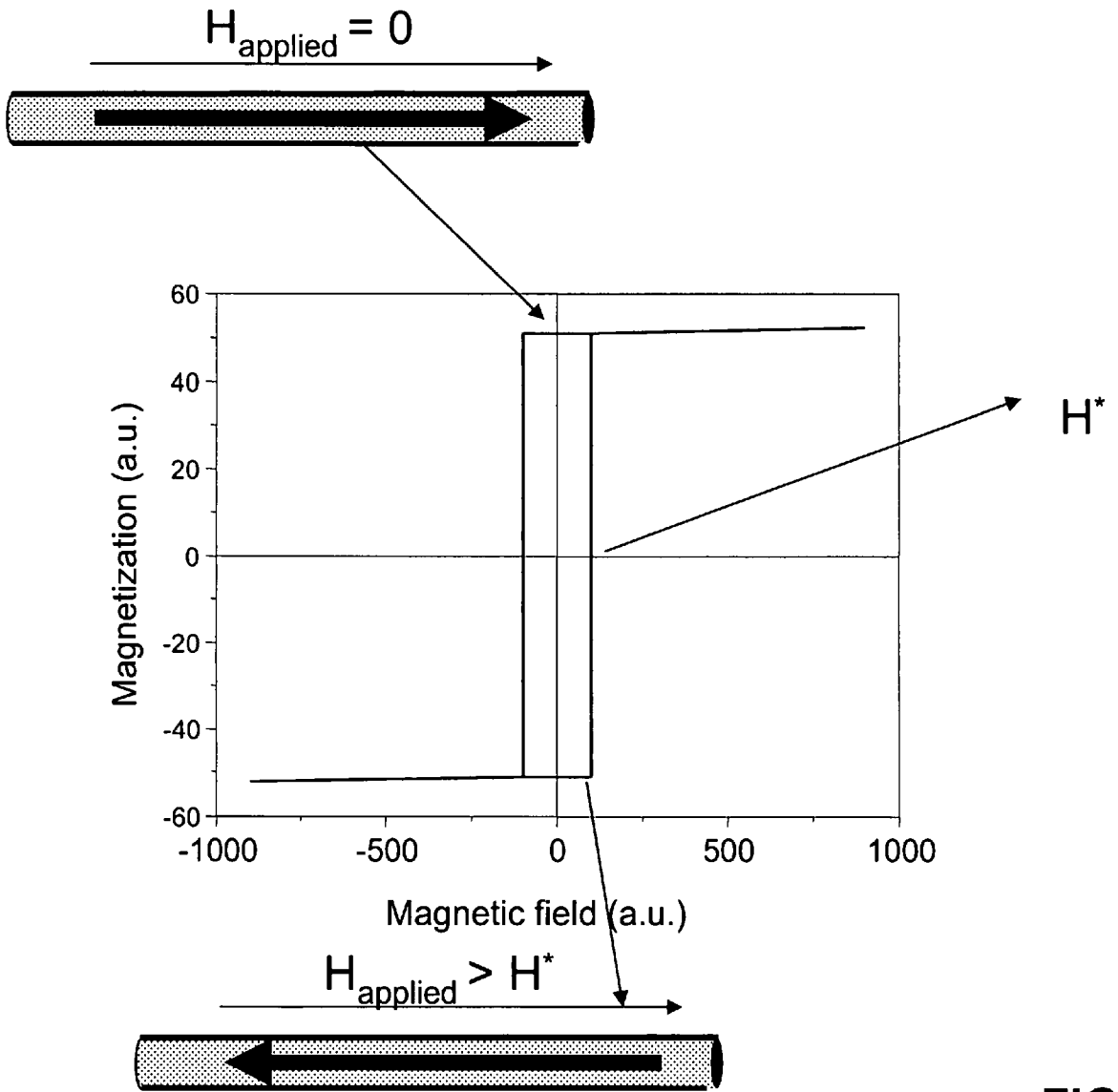
FIG. 2 shows a bistable hysteresis cycle associated to a soft magnetic microwire with longitudinal anisotropy.

FIG. 2 shows a bistable hysteresis cycle associated to a magnetically soft microwire with longitudinal anisotropy. The associated critical field (H*) as well as the magnetic domain structure corresponding to each point in the hysteresis cycle is indicated in it.

Figures 3A, 3B:
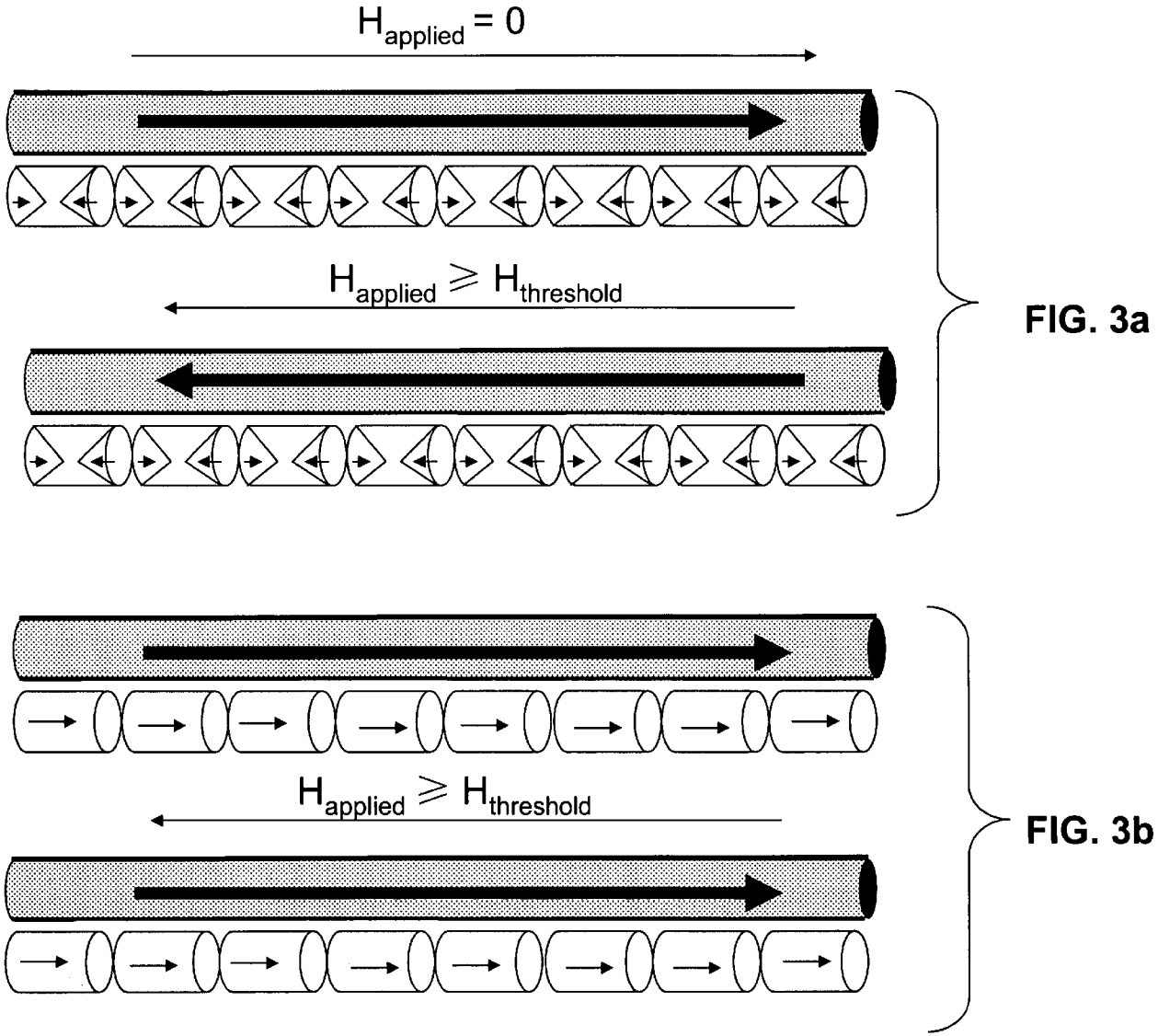
FIGS. 3*a* and 3*b* show the magnetic domain structure associated to an activated and deactivated tag, respectively.

FIG. 3*a* shows the magnetic domain structure associated to an activated tag for an applied magnetic field lower than the threshold value, and the change undergone by the same by the effect of a magnetic field greater than the threshold value.

In a similar way, FIG. 3*b* shows a domain structure associated with a deactivated tag, in the case of a magnetic field greater and less than the threshold value.

According to a preferred embodiment, the tags consist of an amorphous magnetically soft 50 mm wire with composition $Co_{69}Mn_7Si_{11}B_{13}$ and bistable hysteresis cycle, aligned with various wire fractions, of 5 mm in size, equidistant and separated by 4 mm, made of non-bistable hard magnetic material, and obtained by means of the crystallization of the corresponding amorphous microwire of composition $Co_{69}Mn_7Si_{11}B_{13}$. Each of these fractions consists of twelve microwires. The crystallization is carried out both by heat treatment as well as by controlling the corresponding manufacturing parameters.

Figure 4:
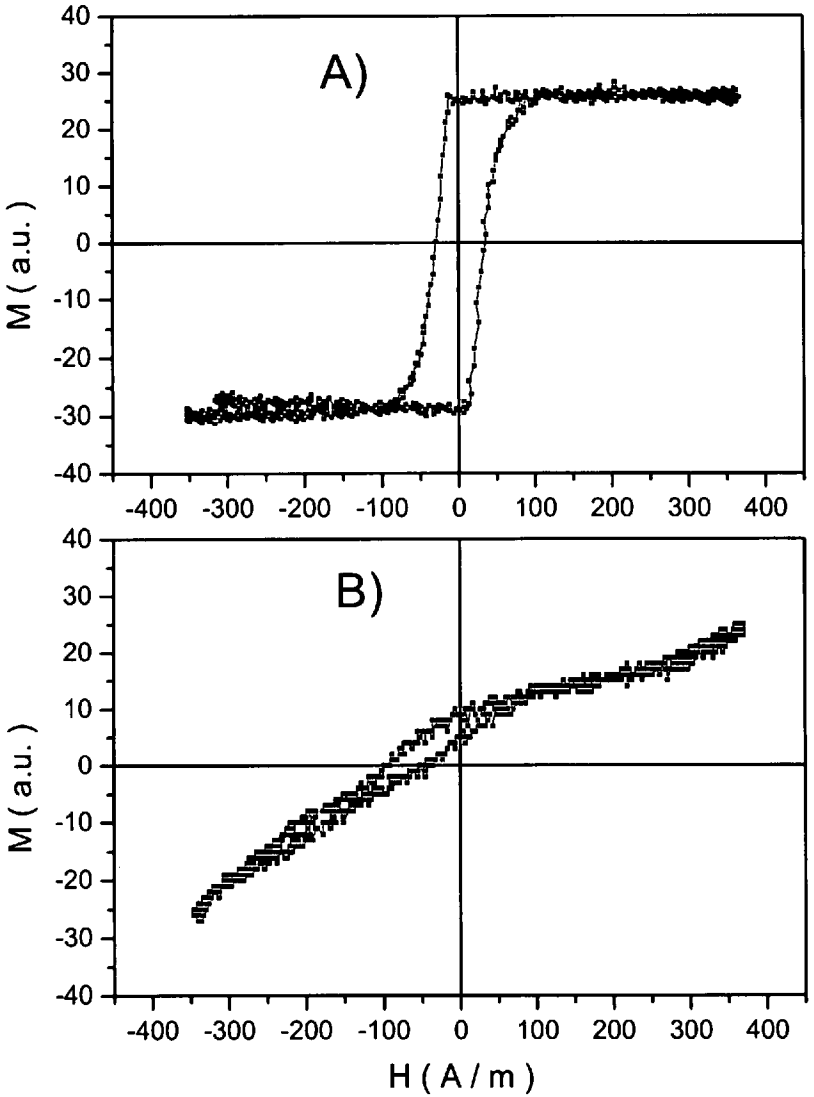
FIG. 4*a* shows a hysteresis cycle associated with a tag formed from an amorphous $Co_{59}Mn_7Si_{11}B_{13}$ 50 mm wire parallel to twelve equidistant 5 mm crystallized wire bundles and separated by 4 mm.
FIG. 4*b* corresponds to a hysteresis cycle associated to this tag in deactivated state.

Tag activation is carried out by applying an alternating magnetic current to the same in such a way that the crystallized material fractions are in the demagnetized state. In this case, as shown in FIG. 4*a*, the hysteresis cycle associated to the tag is bistable.

Tag deactivation occurs by applying a constant magnetic field high enough to magnetize the hard magnetic material fractions. As shown in FIG. 4*b*, the magnetic cycle associated to the tag is no longer bistable.

Figure 5:
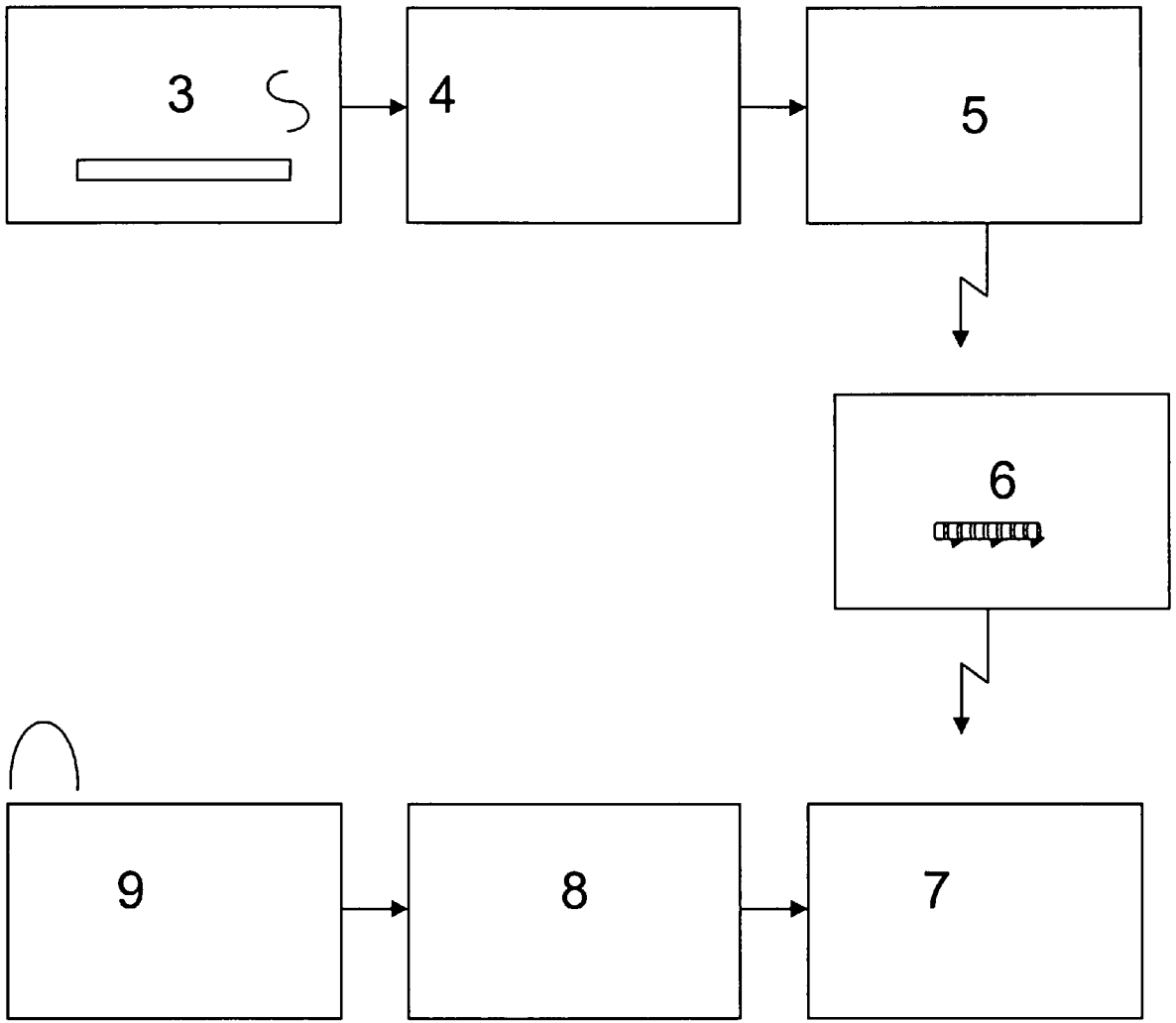
FIG. 5 shows a block diagram of the electronic security arc device used for tag detection.

The operation of the tag is demonstrated by using a security arc, as shown in FIG. 5, the is based on electromagnetic induction. The electronic security arc device used for the detection of tags is formed by: a generator 3, an amplifier 4, a magnetic field-generating coil 5, a tag 6 according to one of the described embodiments, a field receiver coil 7, a receiver 8 and a signal analyzer 9.

The frequency used is 875 Hz and the maximum applied field is 100 A/m. Tag detection is carried out from harmonic thirty-two onwards. The distance between security arc elements is 40 cm.

The invention claimed is:

1. A magnetic tag formed by at least two components based on a magnetic microwire, comprising:

a first component comprises a first array of soft magnetic microwire segments with a bistable magnetic behavior, said segments arranged in a substantially aligned manner in a direction parallel to the axial direction of the microwire, and a second component comprises a second array of hard magnetic microwire segments, said hard magnetic microwire segments being arranged equidistantly from each other and substantially aligned in a direction parallel to that of the first component, wherein the magnetic tag is selectively switched between a deactivated state having a first magnetic behavior and an activated state having a different second magnetic behavior, and wherein a single soft magnetic microwire is subjected to localized heat treatments exceeding crystallization temperature of the soft magnetic microwire to obtain the hard magnetic microwire segments alternated with the soft magnetic microwire segments, wherein when the magnetic tag is in the activated state, the magnetic tag is configured to respond to a magnetic field value that is greater than a critical field of a bistable hysteresis cycle associated with the soft magnetic microwire segments for detection by an induction system.

2. A magnetic tag according to claim 1, wherein the total minimum length of the tag is 35 m.

3. A magnetic tag according to claim 1, wherein said hard magnetic microwire segments have a length between 3 mm and 6 mm.

4. A magnetic tag according to claim 1, wherein said hard magnetic microwire segments are arranged with a minimum distance of between 4 mm and 5 mm between them.

5. A magnetic tag according to claim 1, wherein said magnetic microwire segments of the first and second components have a minimum diameter of 20 μm.

6. A magnetic tag according to claim 1, wherein said soft magnetic microwire has a high longitudinal anisotropy associated to its geometry and to its nil or positive magnetostriction constant.

7. A magnetic tag according to claim 1, wherein the activated state is obtained as a result of subjecting the same to an alternating magnetic field, and the hard magnetic microwire segments being demagnetized.

8. A magnetic tag according to any claim 1, wherein the deactivated state is obtained as a result of subjecting the same to a constant magnetic field, and the hard magnetic microwire segments being magnetized in their remanence state.

9. A magnetic tag according to claim 1, wherein said soft magnetic microwire is configured to give rise to high order harmonics, and with a high amplitude, for yield values lower than 100 A/m.

10. A magnetic tag according to claim 1, wherein said hard magnetic microwire segments have substantially the same length.

11. A method for obtaining a magnetic tag that can be switched been a deactivated state and an activated state, comprising:

obtaining a single soft magnetic microwire with a bistable magnetic behaviour, arranging said soft magnetic microwire segments substantially aligned in a direction parallel to an axial direction of the magnetic tag, and using heat treatment means for subjecting the soft magnetic microwire to localized heat treatments exceeding a crystallization temperature of the soft magnetic microwire to obtain alternating hard magnetic microwire segments, whereupon a magnetic field generating means is used for switching between the deactivated state and the activated state, the magnetic tag assumes a magnetic behavior in the activated state that is different than a magnetic behavior of the magnetic tag in the deactivated state, wherein when the magnetic tag is in the activated state, the magnetic tag is configured to respond to a magnetic field value that is greater than a critical field of a bistable hysteresis cycle associated with soft magnetic microwire segments of the soft magnetic microwire for detection by an induction system.

12. A method according to claim 11, further comprising obtaining a magnetic tag with a total minimum length of 35 mm.

13. A method according to any claim 11, wherein said hard magnetic microwire segments alternate with a distance of between 4 mm and 5 mm between each other.

14. A method according to claim 11, wherein said soft magnetic microwire has a minimum diameter of 20 μm.

15. A method according to claim 11, further comprising activating said magnetic tag by subjecting the same to an alternating magnetic field, and the hard magnetic microwire segments being demagnetized.

16. A method according to claim 11, further comprising deactivating said magnetic tag by subjecting the same to a constant magnetic field, and the hard magnetic microwire segments being magnetized in their remanence state.

17. A method according to claim 11, wherein said soil magnetic microwire gives rise to high order harmonics, and with a high amplitude, for applied field values lower than 100 A/m.

18. A method according to claim 11, wherein said hard magnetic microwire segments have substantially the same length.

* * * * *